United States Patent [19]

Mazuela

[11] 4,247,110

[45] Jan. 27, 1981

[54] GRAVITY PROJECTOR AND SLIDING DISC TARGET GAME APPARATUS

[76] Inventor: Jose L. P. Mazuela, 105-A Mayer Rd., Singapore 15, Singapore

[21] Appl. No.: 43,746

[22] Filed: May 30, 1979

[51] Int. Cl.[3] ..... A63B 71/00

[52] U.S. Cl. ..... 273/126 R; 273/129 Q

[58] Field of Search ..... 273/126 R, 109, 110, 273/127 A, 86 C, 119 R, 120 R, 95 R, 1 R, 129 Q

[56] References Cited

U.S. PATENT DOCUMENTS

| | | | |
|---|---|---|---|
| 336,179 | 2/1886 | Vogelsing | 273/126 R |
| 483,895 | 10/1892 | Buckley | 273/126 R |
| 570,105 | 10/1896 | Ryan et al. | 273/119 R |
| 796,428 | 8/1905 | Howland | 273/109 |
| 1,595,071 | 8/1926 | Carlson | 273/110 |
| 2,532,646 | 12/1950 | Severin | 273/129 E |
| 3,647,215 | 3/1972 | Sterlicchi et al. | 273/126 R |
| 3,985,360 | 10/1976 | Meyers | 273/109 |

*Primary Examiner*—Richard C. Pinkham
*Assistant Examiner*—T. Brown
*Attorney, Agent, or Firm*—Ira C. Edell

[57] ABSTRACT

A game has as its object to move a playing piece, in the form of a segment of a sphere, along a low-friction game board surface by dropping a ball or other object onto the playing piece. In a preferred embodiment the ball is permitted to ride on a track formed by two flexible members held in tension by the player. Upon release of the tension the ball drops. The game board is marked with different areas into which the playing piece is to be moved.

6 Claims, 4 Drawing Figures

10
11
12
13
14
15
16
17
18
19
21
22
23
24
25
26
27
28
29
2

GRAVITY PROJECTOR AND SLIDING DISC TARGET GAME APPARATUS

TECHNICAL FIELD

The present invention relates to games of the type which require a certain dexterity on the part of the player. More particularly, the present invention is a game which is capable of maintaining a player's interest while improving his eye-hand coordination.

BACKGROUND ART

The prior art includes a game whereby two rods, enclosed at one end, are pivotable in a plane to define a track for a ball. By separating the rods beyond the width of the ball a player can attempt to cause the ball to fall into one or more predetermined scoring bins. A modification of such a game is found in U.S. Pat. No. 3,985,360 to Meyer wherein none of the rod ends are anchored so that two players, one at either end, can compete simultaneously to try to control where the ball is dropped.

It has been found that games of the type described retain a player's interest for a relatively short time. This has been theorized as being due to the fact that the technique for dropping the ball in a relatively large scoring area can be mastered after continued play, leaving little, if any, challenge in the playing of the game.

DISCLOSURE OF THE INVENTION

In accordance with the present invention, a ball is permitted to roll along a track defined by two separable members, much as in the aforementioned prior art games. However, the ball in the game of this invention is intended to be dropped onto a playing piece taking the form of a spherical segment which rests on a low friction game board surface. Depending upon the portion of the playing piece struck by the ball, a horizontal force is imparted to the playing piece which is thereby propelled along the game board. The game board is subdivided into prescribed areas, the object being to propel the playing piece into those areas.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings wherein.

BEST MODE OF CARRYING OUT THE INVENTION

Figures 1, 2:
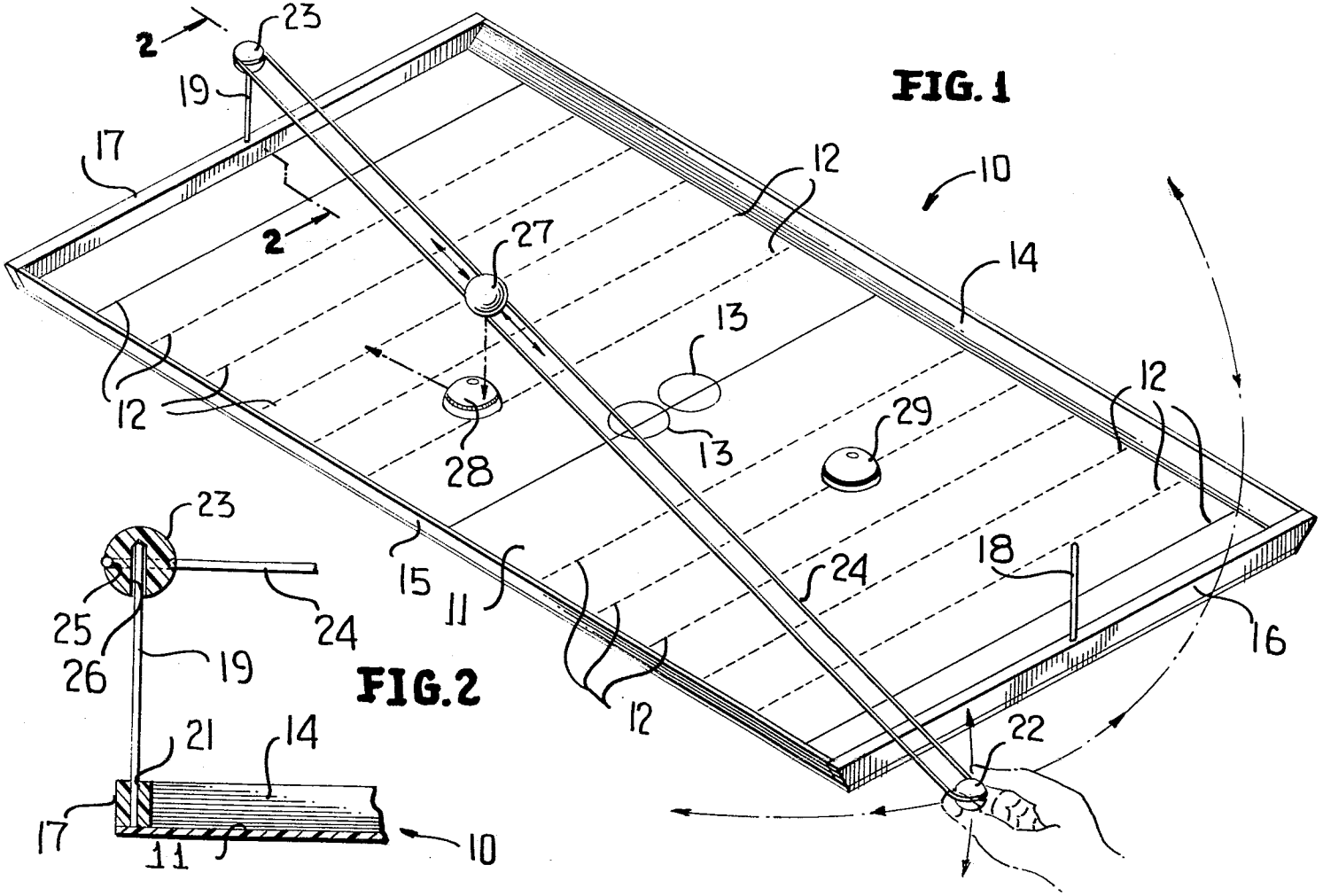
FIG. 1 is a view in perspective of a preferred embodiment of the game of the present invention, including a diagrammatic representation of the manner in which the game is played.
FIG. 2 is a view in perspective taken along lines 2—2 of FIG. 1.

Referring to the drawings with greater specificity, a game board 10 is in the form of a flat rectangular member having a low friction top surface 11 made of plexiglass or the like. Surface 11 has a plurality of spaced parallel lines 12 marked thereon and extending across the smaller rectangular dimension of the board 10. The lines 12 give the board an appearance similar to that of a football field. A pair of circular markings 13 also appear on surface 11 and are located along the centermost of lines 12 on opposite sides of an imaginary longitudinal centerline of the board. Upstanding sidewalls 14 and 15 are disposed along the longer edges of board 10 and upstanding end walls 16 and 17 are disposed along the shorter board edges.

A rigid dowel-like post 18 is adapted to be inserted into and supported in a vertical position by a hole 20 extending vertically through end wall 16 at a location substantially at the center of the end wall. A similar post 19 is supported in a similar hole 21 in end wall 17.

A track unit includes a pair of spherical members 22 and 23 and an endless cord or rope 24 or the like. The cord 24 is subdivided into two tracks of equal length by securing it about a portion of the periphery of each spherical member 22 and 23. For this purpose each spherical member 22, 23 may be provided with channel 25 extending around a portion of its periphery and within which a portion of the cord 24 resides. Adhesive or the like firmly secures the spherical members to the cord. The spherical members 22 and 23 also include a cylindrical bore defined partially therethrough along a diameter which is perpendicular to the plane of channel 25. Bore 26 is adapted to receive the top of post 19 (or post 18) whereby the speherical member is supported by the post above the end wall 17 (or 16).

Additional parts of the game include a ball 27 and playing pieces 28 and 29. Ball 27 is adapted to ride between the tracks defined by cord 24 when the cord is held taut. Playing pieces 28 and 29 are in the form of minor spherical segments which are placed concave-downward on the playing surface 11 of board 10. Playing pieces 28 and 29 are preferably made of plastic or other lightweight material which is capable of freely sliding along playing surface 11. Ball 27 may be plastic or wood and is sufficiently heavy to accomplish the objects of the game as described below.

Figure 3:
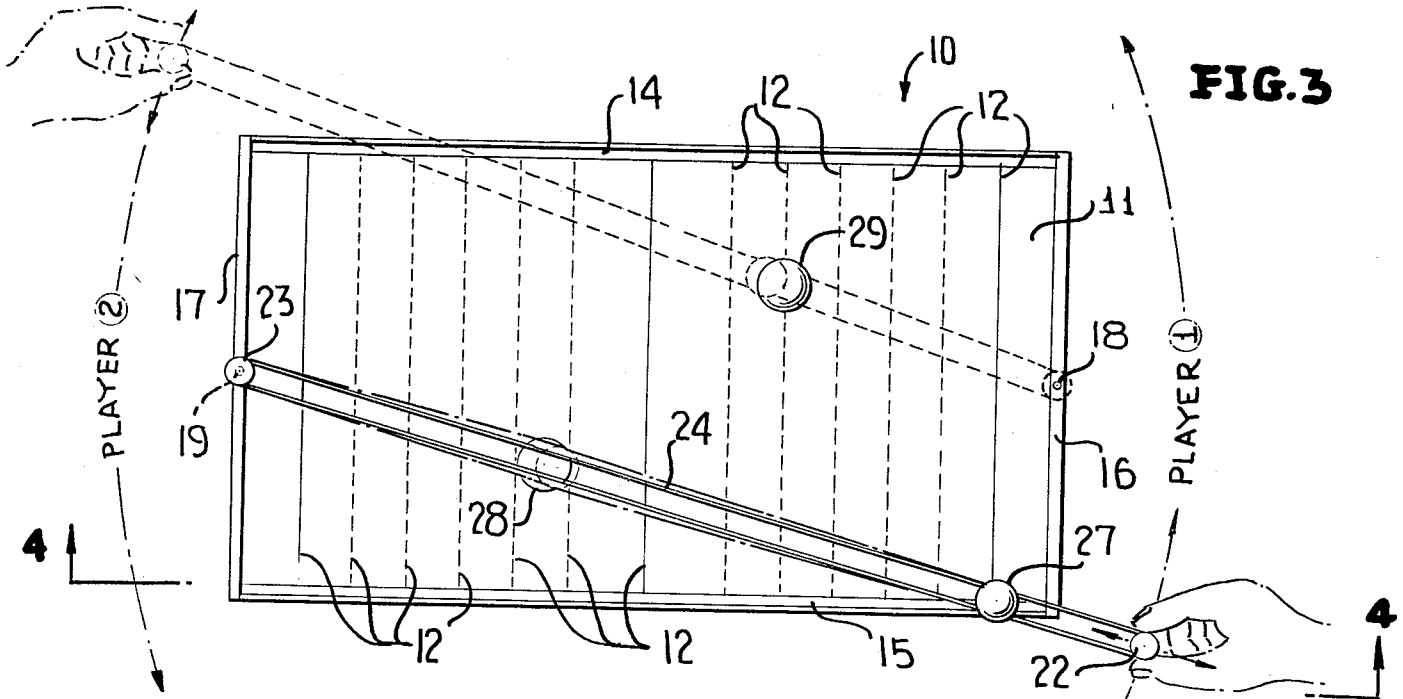
FIG. 3 is a top view in plan of the game of FIG. 1.
Figure 4:
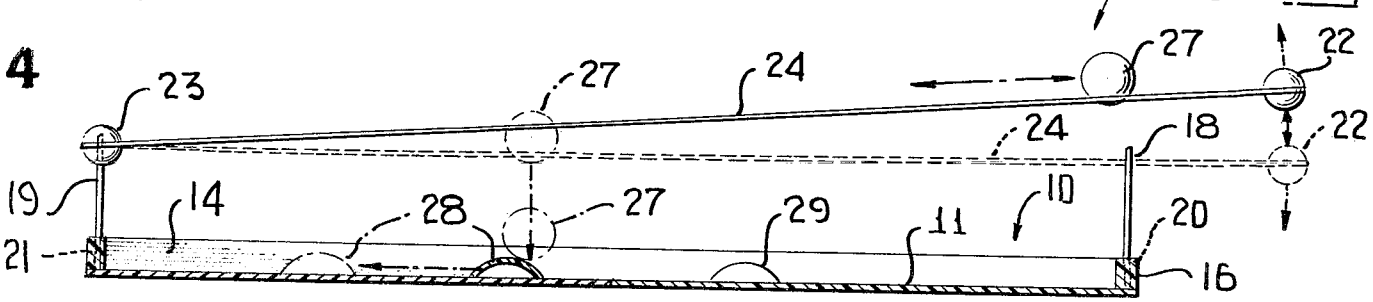
FIG. 4 is a view in section taken along lines 4—4 of FIG. 3.

The object of the game is to move playing pieces 28 and 29 to predetermined locations on playing surface 10 by dropping ball 27 onto the playing piece from the track defined by cord 24. More specifically, when spherical member 23 is positioned atop post 19 as illustrated in FIG. 1, the player pulls on spherical member 22 until cord 24 is taut. Ball 27 is then permitted to roll between the two sections of the cord by raising or lowering ball 22 (see FIG. 4) until the ball is over the playing piece 28, for example. The player then releases the tension in cord 24, permitting the ball 27 to drop onto the playing piece. In so doing, the player should attempt to have the ball strike the playing piece off-center of the playing piece in order to impart a horizontal force to the piece. If the ball strikes the playing piece directly on center, no horizontal force is created and the playing piece remains stationary. As the playing piece is moved to different board locations, the player can rotate the track assembly about post 19 (as best seen in FIG. 3) to bring the track assembly over the piece.

In one approach to playing the game, two players can each be assigned a respective playing piece 28 or 29. The playing pieces are placed in starting positions defined by circular markings 13. The players then take turns trying to move their playing piece past the other player's goal line which is the last line 12 at either end of the playing surface. Player No. 1, for example, attaches spherical member 23 to post 19 and rolls ball 27 on the track until it is dropped. Player No. 2 then removes member 23 from post 19 and instead places member 22 on post 18. Player No. 2 then attempts to drop ball 27 from the track to strike and move playing piece 29. Of course, the players can attempt to move the other player's piece in an attempt to thwart the other player's progress.

The game can also be played competitively with one playing piece whereby both players attempt to move that piece in opposite directions to score a goal. Of course, the game may also be played by a single player who can take the part of both players by moving one or both playing pieces in different directions.

The board may be marked in various other ways rather than with the parallel lines 12. For example, different circles, squares or other marked areas may be defined at different locations on the board, the object being to move the playing piece into those areas. Different point scores may be assigned different areas for this purpose. In this regard, the spaces between lines 12 in the illustrated embodiment may serve the purpose of scoring areas.

It is also within the scope of the invention to support the track member in other ways. For example, by holding spherical members 22 and 23, one in each hand, the player can hold cord 24 taut and then release it to drop the ball 27 when desired. Likewise, posts can be provided at different locations in the end and side walls. It should also be noted that the track mechanism may comprise two rigid bars, pivotally fixed at one end. Further, multiple playing pieces may be used with the object being to align the pieces in a predetermined pattern by moving them solely by means of dropping ball 27.

The playing pieces may also take different shapes although I have found that the minor spherical segment is quite advantageous because it demands accurate impact in order to be moved a considerable distance.

While I have described and illustrated one specific embodiment of my invention, it will be clear that variations of the details of construction which are specifically illustrated and described may be resorted to without departing from the true spirit and scope of the invention as defined in the appended claims.

I claim:

1. A game comprising:

a substantially horizontally disposed, relatively low-friction playing surface;

a playing piece adapted to slide along said playing surface when struck from above at predetermined regions of said playing piece;

an impact member;

player-controlled means for selectively moving said impact member above said playing surface, said player-controlled means including further means for selectively dropping said impact member in unguided free fall onto said playing surface;

whereby, the object of said game is to drop said impact member from said-player-controlled means to strike said predetermined regions playing piece and slide it along said playing surface.

2. The game according to claim 1 wherein said playing piece is a minor segment of a sphere having concave and convex surfaces, said playing piece being disposed with said concave surface downward on said playing surface.

3. The game according to claims 1 or 2 wherein said impact member is a ball.

4. The game according to claim 3 wherein said player-controlled means is a track assembly including two tracks between which said ball can roll, said tracks being selectively tiltable to permit player-controlled movement of the ball therealong, and wherein said tracks can be selectively separated to permit the ball to drop onto said playing surface.

5. The game according to claim 4 wherein said two tracks are flexible rope-like members which when held taut support said ball, and wherein said tracks can be separated by releasing the tautness of said rope-like members.

6. The game according to claim 5 wherein said player-controlled means includes an upstanding post, and means securing said two tracks to said post in a manner to permit horizontal and vertical pivoting of said tracks about said post.

* * * * *